United States Patent [19]

Turner, Jr. et al.

[11] 4,005,621

[45] Feb. 1, 1977

[54] DRILLING TONG

[75] Inventors: John W. Turner, Jr.; Russell A. McLaughlin, both of Houston, Tex.

[73] Assignee: Joy Manufacturing Company, Pittsburgh, Pa.

[22] Filed: Apr. 27, 1976

[21] Appl. No.: 680,604

[52] U.S. Cl. ..... 81/57.2

[51] Int. Cl.[2] ..... B25B 17/00

[58] Field of Search ..... 81/57.2, 57.15, 57.18, 81/57.21; 29/283

[56] References Cited

UNITED STATES PATENTS

| | | | |
|---|---|---|---|
| 2,703,221 | 3/1955 | Gardner | 81/57.2 |
| 3,196,717 | 7/1965 | Sheppard | 81/57.2 |
| 3,892,148 | 7/1975 | Wiley | 81/57.2 |

*Primary Examiner*—James L. Jones, Jr.

[57] ABSTRACT

A tong and more particularly an open head tong of the type utilized to handle large diameter work pieces, such as drill pipe and casing for oil field applications, and including means to adjustably engage peripheral portions of such work pieces.

16 Claims, 4 Drawing Figures

DRILLING TONG

One type of open head tongs having non-rotatable gripping elements which has been utilized heretofore included a pair of drametically opposed tong dies which were biased into engagement with the work piece. This tong quite often provided gripping on only a 180° quadrant of the work piece or provided gripping at only two locations thereby: increasing the potential of the work piece being dislodged from the tong grip; increasing the potential of damage of the work piece because of overstressing at either or both of the points of contact with the work piece; and/or necessitating a plurality of different tong dies or manual die adjustments over a very small range of work piece diameters. These problems are particularly acute when the tone is used in oil field applications, for example as a backup tong where the range of applied torques may exceed 40,000 Ft-lb. and the tong may be expected to handle a wide range of drill pipe diameters such as 4¼ to 7¼ inches.

An alternative to the two tong die system utilizes more than two dies and a latching door. This alternative system would aid in the problems of the work becoming dislodged and would provide more than two point contact; however, the mechanical configurations of such prior systems limited the range of work diameters which could be utilized.

By means of the present invention which includes an open tong which is structured to generally freely receive the work piece therewithin and thereafter engage, independently of a latching door, the work piece at a plurality of locations no more than 120° apart, the hereinabove mentioned problems are generally alleviated. Furthermore, the tong of the present invention includes means for camming engagement of the tong dies with the work piece in a manner that all tong dies engage the work piece simultaneously and equal forces are applied thereto. Still further, a lost motion arrangement with the tong jaws of the present invention provides an even greater range of work diameters which may be used with a single tong constructed according to the principles of the present invention.

These and other objects and advantages of the present invention will become apparent from a reading of the following details and drawings in which.

Figure 1:
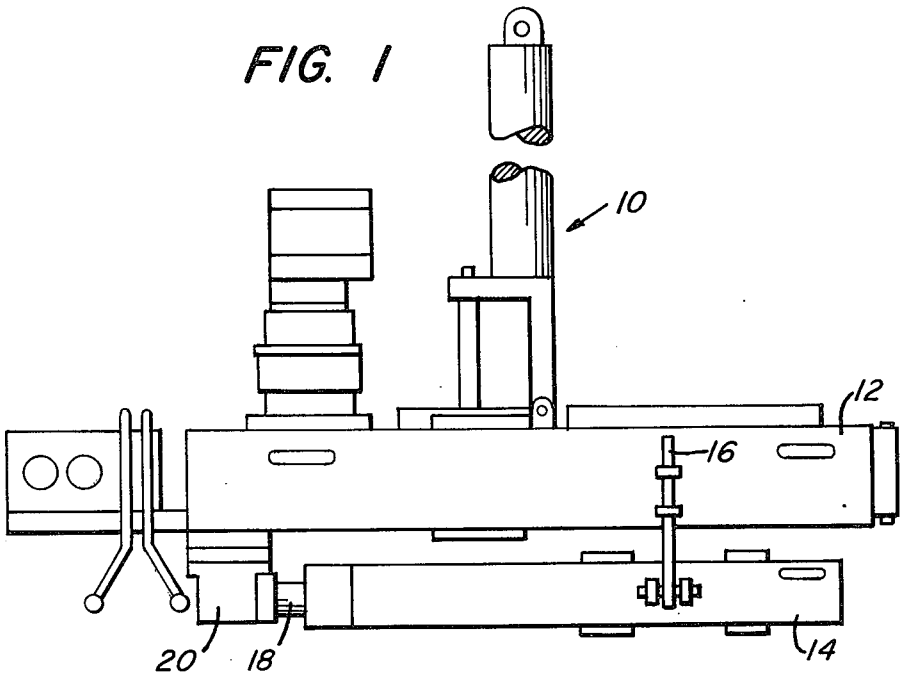
FIG. 1 is a schematic illustration of power and backup tong assembly which incorporates a backup tong constructed in accordance with the principles of the present invention.
Figure 3:
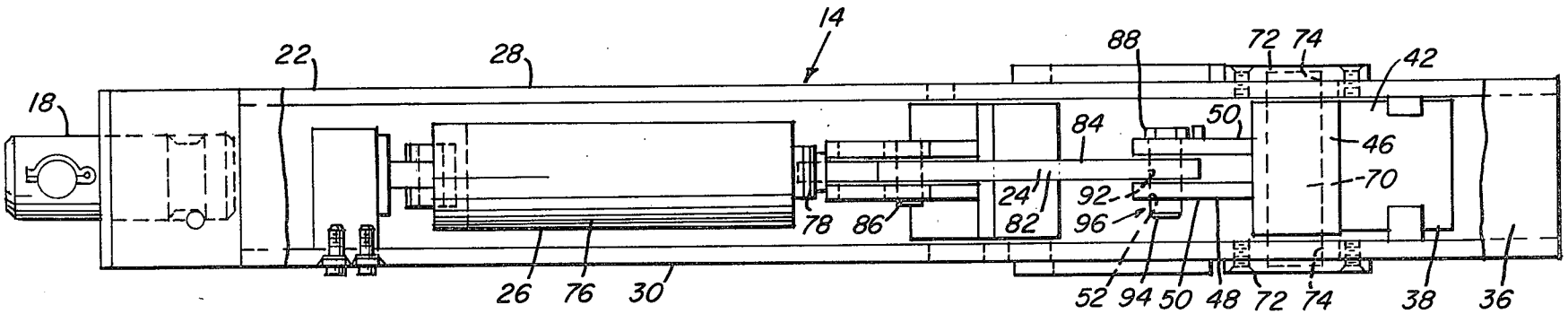
FIG. 3 is a side view of the tong illustrated in FIG. 2.

FIG. 1 is a schematic illustration of power and backup tong assembly 10 comprising a suitable power tong 12 which carries a backup tong 14 of the present invention. Power tong 12 is any suitable construction and as shown supports backup tong 14 therefrom by means of releasable side support assemblies 16 and a rear assembly 18 which communnicates between backup tong 14 adjacent the rearward end thereof and a suitable torque transmitting assembly 20. Torque transmitting assembly 20 extends downwardly from power tong 12 adjacent the rearward end thereof. As is known with a unit such as assembly 10 the backup tong 14 is carried by power tong 12 to oppose the rotational reaction force of the power tong 12 when making up or breaking out of a threaded joint of pipe. The backup tong 14 prevents the free spinning of the lower portion of the pipe and eliminates the real need of a backup cable which presents a myriad of problems not the least of which is the bending of the pipe being coupled or uncoupled. In operation the tongs 12 and 14 grip adjacent pieces of pipe or collars being coupled or uncoupled.

Backup tong 14 comprises an elongated generally hollow main casing 22; a jaw assembly 24 received within casing 22; and a hydraulic or pneumatic actuator means or piston assembly 26 which is received within casing 22 and is selectively operable to extend and retract respective elements of jaw assembly 24 to engage and disengage the work.

Main casing 22 comprises spaced top and bottom walls 28 and 30, respectively, which include a forwardly open rearwardly extending opening 32 therewithin which is generally defined by an inner periphery 34 which tapers slightly inward from the open end thereof to a generally straight portion and terminates in a semi-circular portion at the rearwardmost end thereof. Walls 28 and 30 are maintained in spaced relationship and structural rigidity therebetween is achieved by vertical walls 36 which extend substantially continuously therebetween adjacent the outer periphery thereof. The forwardmost ends of walls 36 terminate adjacent the respective sides of the forward open end of opening 32. It is noted that the transverse dimension of opening 32 is of a size to readily receive a variety of differing diameter work or pipes therewithin.

Figure 2:
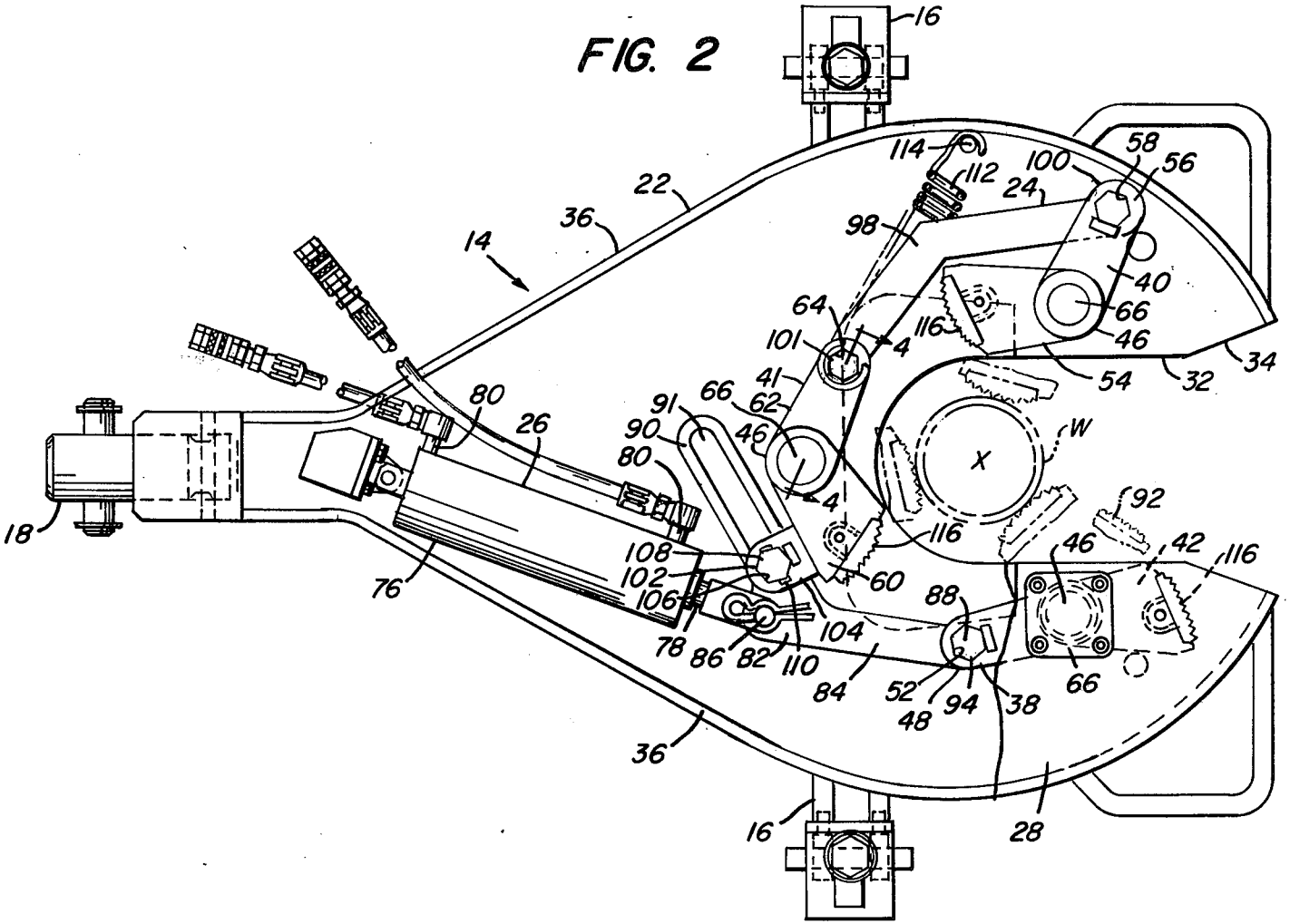
FIG. 2 is a plan view, with the top plate removed of a backup tong as illustrated in FIG. 1 and constructed in accordance with the principles of the present invention.

Jaw assembly 24 comprises a plurality of spaced tong jaws or jaw crank arms which are pivotally carried within casing 22 adjacent the periphery 32 and as illustrated in FIG. 2 include forward tong jaws or jaw crank arms 38 and 40 and a rear tong jaw or jaw crank arm 41. As indicated in the drawings jaw crank arms 38, 40 and 41 are shown in solid in their open position and shown in phantom in their respective closed positions.

Crank arm 38 comprises: an elongated tong die carrying portion 42 which carries a tong die 116 at the free end thereof; a suitable pivot portion or connecting sleeve 46, formed in any suitable manner, for example as a through bore or as a hollow cylindrical vertically extending pivot sleeve rigidly secured to portion 42 or integrally formed therewith adjacent the opposite end thereof; and a biforcated link arm connecting portion 48 which is rigidly secured to sleeve 46 and extends rearwardly therefrom generally along an axis extending in the direction of the longitudinal extent of portion 42. Connecting portion 48 includes a pair of spaced connecting members 50 having vertically aligned bores 52 therethrough which are utilized for the pivotal connection to a link arm as described hereinafter.

Crank arm 40 is similar in construction to arm 38 described hereinabove and comprises: an elongated tong die carrying portion 54 which carries a tong die 116 at the free end thereof; a pivot portion 46 rigidly secured to or integrally formed with portion 54 adjacent the other end of arm 40; and a link connecting portion 56 which communicates with portion 46 and extends therefrom along an axis which intersects, at an obtuse angle, an axis drawn through the longitudinal extent of portion 54. Link connecting portion 56 is shown as having a vertical bore 58 therethrough for pivotal connection to a link arm as described hereinafter. Crank arm 41 is substantially similar in operative description to crank arm 40; however; for ease of description hereafter the tong die carrying portion, link connecting portion and the vertical bore through the link connecting portion are respectively assigned differing reference numerals 60, 62 and 64.

Figure 4:
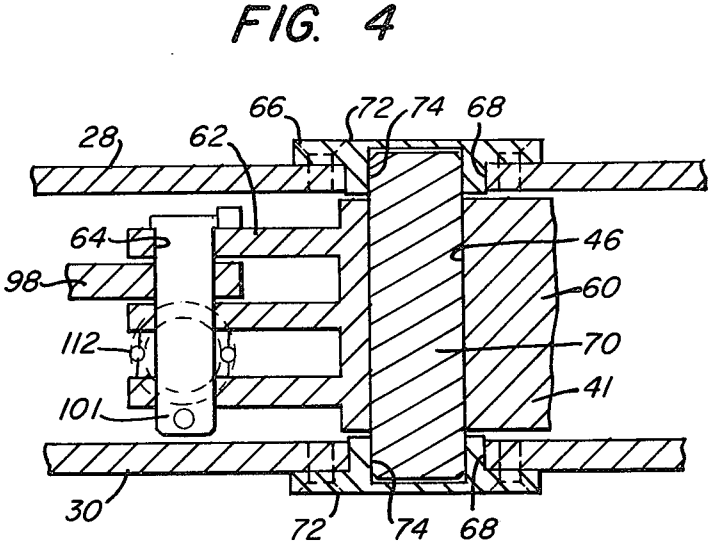
FIG. 4 is a cross-sectional view taken on lines 4—4 of FIG. 2 illustrating a typical jaw and pivot pin arrangement.

Crank arm 40 is pivotally carried within main casing 22 by a vertically extending pivot assembly 66 which is positioned in casing 22 outwardly adjacent one side of the straight portion of opening 32. Pivot assembly 66 comprises: vertically aligned bores 68 which extend through top and bottom walls 28 and 30; a vertically extending pivot pin 70 which is received through the pivot portion 46 of crank arm 40; and top and bottom end retainer caps 72 which have a downwardly open depression 74 therewithin to retain the respective axial ends of pivot pin 70. End caps 72 are secured to casing 22 in any suitable manner and are shown in FIG. 4 as having a portion thereof received within the interior of respective bores 68.

Crank arms 38 and 41 are pivotally carried within main casing 22 in a manner identical to that discussed above with reference to crank arm 40. The pivot assembly 66 for crank arm 38 is positioned on casing 22 outwardly adjacent the side of the straight portion of opening 32 directly opposite from crank arm 40. The pivot assembly 66 for crank arm 41 is positioned on casing 22 rearwardly adjacent the inner closed end of opening 32.

Piston assembly 26 is positioned within a rearward portion of casing 22 and comprises a double acting piston assembly 76 having a piston rod 78 reciprocably driven by means of a suitable fluid under pressure being alternatively supplied through suitable fluid power inlets 80 located at respective axial ends of assembly 76. To extend the piston rod 78 fluid under pressure is supplied to the rear inlet 80 and the forward inlet 80 is directed to tank or atmosphere. Conversely to retract the piston rod 78 fluid under pressure is supplied to the forward inlet 80 and the rear inlet 80 is directed to tank or atmosphere. The rear end of piston assembly 26 is carried adjacent a rear end portion of casing 22 and the forward end thereof is suitably pivotally connected to a link arm 82.

Link arm 82 comprises: an elongated direct link portion 84 having the rear end thereof pivotally connected to the forward end of piston 76 at pivot assembly 86 and having the forward end thereof pivotally connected to crank arm 38 at pivot assembly 88; and an elongated lost motion link portion 90 which extends outwardly from link portion 84 in a manner that the longitudinal axis thereof is at an obtuse angle with respect to the longitudinal axis of link portion 84. Link portion 90 includes an elongated longitudinally extending slot 91 therethrough along substantially the entire length thereof.

Pivot assembly 88 includes a vertical bore 92 through the forward end portion of link portion 84. Bore 92 is coaxially aligned with bores 52 and a pivot pin 94 is inserted therethrough. Pivot pin 94 is retained in position in any suitable manner, for example a cotter pin 96. Pivot assemblies such as pivot assembly 86 and others to be specified hereinafter are of similar construction to pivot assembly 88. Accordingly, detailed description of such pivot assemblies will not be given except where necessary to describe particular elements.

An elongated bent link arm 98 communicates between crank arms 40 and 41 with one end of link arm 98 being pivotally connected to crank arm 40 with a pivot assembly 100 at bore 56 and the other end of link arm 98 being pivotally connected to crank arm 41 with pivot assembly 101 at bore 64. Link arm 98 and crank arms 40 and 41 communicate with link arm 82 at lost motion connection 102. Lost motion connection 102 comprises a pair of vertically spaced ears 104 which extend outwardly from rear crank arm 41 and include vertically aligned bores 106 therethrough. The lost motion link portion 90 is received between ears 104 and the slot 91 is aligned with bores 106 in a manner that a vertically extending pivot pin 108 is received through the bores 106 and slot 91. The pivot pin 108 is retained in assembled position in any suitable manner, for example cotter pin 110.

Link arm 98 and crank arms 40 and 41 are continuously urged toward the open or retracted position illustrated in FIG. 2 by biasing means, shown as an elongated spring 112. Spring 112 is received within casing 22 and has one end thereof releasably secured to a vertical pin 114 which extends rigidly between top and bottom walls 28 and 30. The other end of spring 112 is releasably secured to pivot assembly 101.

With a backup tong 14 as described hereinabove and the jaw assembly 24 in an open position as shown in FIG. 2, wherein all elements of arms 38, 40 and 41 and of link arms 82 and 98 are within the casing 22 and retracted from opening 32, the work or pipe W is easily received within opening 32 with no fear of contacting or damaging the elements of jaw assembly 24 during initial set up.

It is noted that in certain instances, for example where arms 38, 40 and 41 are changed to accommodate a range of pipes different from the range accommodated by the illustrated embodiment, that the outermost end of the arm 38 may extend slightly into the opening 32 in the retracted position. Nevertheless this slight obstruction, for example 1 inch will still allow easy insertion of a large range of work diameters within the opening 32.

After reception of the work W with opening 32 the piston assembly 26 is energized to extend the piston rod 78. The piston rod 78 pushes on link arm 82 causing arm 82 to move forward which in turn results in pivot assembly 88 moving outward. The outward movement of piston assembly 88 causes forward crank arm 38 to rotate counterclockwise about the respective pivot assembly 66 therefor. During this initial movement and rotation of forward crank arm 38, crank arms 40 and 41 and link 98 remain biased into their retracted positions and do not move by virtue of the lost motion arrangement existing between the lost motion connection 102 and the slot 91 in the lost motion link portion 90. During this initial movement and rotation, pivot pin 110 of the lost motion connection 102 slides rearwardly along slot 91 until the instant the pin 110 contacts the rear end of slot 91 adjacent the free end of the lost motion link portion 90. At this instant crank arm 38 has rotated to the position indicated by the reference 92 and arm 38 and arms 40 and 41 are all in a fixed relationship to each other and have identical angular relationship (generally 120° apart) to the center of the backup tong which is indicated with an X placed within opening 32. Prior to this time crank arm 38 did not have an equal angular relationship with arms 40 and 41 because of the necessity of allowing a clearance opening 32 for the insertion of the work.

With pivot pin 110 contacting the end of slot 91 the extension of piston rod 78 continues thereby continuing the rotation of crank arm 38 about the respective pivot assembly therefore while simultaneously pushing on crank arm 41 and causing the counterclockwise rotation thereof about the respective pivot assembly 66 therefor. This rotation of crank arm 41 results in the rearward and outward movement of pivot assembly 101 which in turn pulls on link arm 98 to cause the counterclockwise rotation of crank arm 40 about the respective pivot assembly 66 therefor. This rotation of crank arms 38, 40 and 41 continues in unison until the replaceable arcuate tong dies 116 carried at the free ends of such arms engage the work W. At this point it is noted that although spring 112 is tensioned and opposing the piston assembly 26, the resulting spring biasing force is insignificant.

With the tong dies now engaging the work or pipe W, the power tong 12 rotates a joint of pipe clockwise, when making up a threaded connection, and the pipe W is restricted from rotation by the crank arms 38, 40 and 41 as the respective dies 116 therefor firmly engage and cam into the pipe W at respective angular positioning of approximately 120°. Once the dies 116 firmly engage the pipe W bearing rotated, the jaw assembly 24 becomes self-energizing. When the casing 22 of the backup tong 14 attempts to rotate, as it will when the backup tong 14 resists the pipe rotation, the resulting torque moment is transmitted to the frame of the power tong 12 by the force reaction. Although very high torque levels may be encountered in makeup or break down (i.e. 40,000 to 100,000 ft-lb), the power tong 10 and backup tong 14 acts as an integral unit and no external restrains are theoretically required.

After the threaded joint has been made up to the proper torque requirement, the pressure fluid is then applied to the forward end of piston assembly 26 causing the piston rod 78 to retract. This release of the directly applied closing force on crank arm 41, coupled with the continuous opening bias erected by the spring 112 will result in the rapid repositioning of crank arms 40 and 41 and link arm into the open position illustrated in FIG. 2. The retraction of piston rod 78 is continued until portion 42 is pivoted into the fully open position of FIG. 2.

The jaw assembly 24 is unidirectional. Accordingly, suitable means are provided to make backup tong 14 invertible in a manner that an operator may select the proper position to oppose the power tong (i.e. make up or break down position). Although not shown in detail a system for inverting tong 14 is generally illustrated wherein release of side support assemblies 16 would result in the forward portion of tong 14 dropping down by rotation about a first transverse axis at rear assembly 18 and thereafter the tong 14 is inverted by rotation about another transverse axis at rear assembly 18 which is perpendicular to the first transverse axis. The side support assemblies are then reconnected on the inverted tong 14 and the tong would now be operable for pipe break down rather than make up as was described hereinbefore.

It is to be understood that the invention herein is directed to a tong having an improved jaw system and modifications to the preferred embodiment described hereinbefore may be made by one skilled in the art without departing from the scope of the invention which is only defined by the claims appended hereto, for example: it is possible to utilize more than three jaws; if desired a manual system may be used for extension or retraction of jaw assembly 24 rather than the illustrated piston assembly 26 or as an override used in conjunction with the assembly 26; a pivotal gate may be provided to selectively close off opening 32; the jaw, link and pivot assembly configurations may vary; other sets of jaws may be provided to accommodate additional ranges of pipe diameter (i.e. one set of jaws for pipe diameter 4½ inches to 5⅝ inches and another set for pipe diameter 5½ to 7¼ inches); a tong constructed in accordance with the principles of the present invention may be used as a primary tong rather than a backup tong as described; and the like.

What is claimed is:

1. A gripping tong comprising: a main body housing having an interior cavity in open communication with a forwardly open member receiving opening; a plurality of at least three pivotal tong jaws having free member ends and received within said interior cavity in spaced relationship to each other about the periphery of said member receiving opening; means for selectively pivoting said tong jaws through a range of positions including a fully retracted position and member gripping positions; said tong jaws, in said fully retracted position, being retracted from said opening at least a sufficient amount to permit a member to be received within said opening; and said free ends of said tong jaws, in said member gripping positions, being pivoted to grip such a member received within said opening at peripherally spaced intervals of less than 180°.

2. A gripping tong as specified in claim 1 wherein said free ends of said tong jaws grip such a member within said opening at peripherally spaced intervals of no more than 120°.

3. A gripping tong as specified in claim 2 wherein said plurality of tong jaws is three tong jaws.

4. A gripping tong as specified in claim 1 wherein said means for pivoting includes a linkage assembly interconnecting said tong jaws and a fluid operable piston assembly in operable communication with said linkage assembly.

5. A gripping tong as specified in claim 3 wherein during at least a later portion of the pivoting of said tong jaws into member gripping positions, each of said tong jaws is in substantially equal angular relationship with the other of said tong jaws and said equal angular relationship is maintained throughout said later portion of the pivoting.

6. A gripping tong as specified in claim 5 wherein during an initial portion of said pivoting of said tong jaws into member gripping positions only a single one of said tong jaws is pivoted and the other of said tong jaws are in equal angular relationship with respect to each other.

7. A gripping tong comprising: a main body housing having an interior cavity in open communication with a forwardly open member receiving opening; a plurality of at least three pivotal tong jaws having free ends and received within said interior cavity in spaced relationship to each other about the periphery of said member receiving opening; means for selectively pivoting said tong jaws through a range of positions including a fully retracted position, when receiving a member within said opening, and member gripping positions when said free ends are gripping a member received within said opening; said means being operable when pivoting said tong jaws into member gripping positions to initially pivot at least one of said tong jaws until said at last one tong jaw is in substantially equal angular relationship with the other of said tong jaws and thereafter pivoting all of said tong jaws while simultaneously maintaining said substantially equal angular relationship.

8. A gripping tong as specified in claim 7 wherein said free ends of said tong jaws grip such a member within said opening at peripherally spaced intervals of no more than 120°.

9. A gripping tong as specified in claim 8 wherein said plurality of tong jaws is three tong jaws.

10. A gripping tong as specified in claim 7 wherein said means for pivoting includes a linkage assembly interconnecting said tong jaws and a fluid operable piston assembly in operable communication with said linkage assembly.

11. A gripping tong as specified in claim 10 wherein said linkage assembly includes a lost motion connection between said other of said tong jaws with respect to said one of said tong jaws.

12. A gripping tong as specified in claim 11 additionally including biasing means operable to continually bias said other of said tong jaws towards said fully retracted position.

13. A gripping tong comprising: a main body housing having an interior cavity in open communication with a forwardly open member receiving opening; a plurality of at least three movable tong jaws having free ends and received within said interior cavity in spaced relationship to each other about the periphery of said member receiving opening; first linkage means movably connected to at least two of said tong jaws; second linkage means movably connected to the other of said tong jaws and having a lost motion connection with respect to said first linkage means; selectively movable activating means cooperable with each of said linkage means to move said tong jaws through a range of positions including a fully retracted position, when receiving a member within said opening, and member gripping positions when said free ends are gripping a member received within said opening; and said lost motion connection being operable when said actuating means are moving said tong jaws into member gripping positions to move only said other of said tong jaws during an initial portion of such movement and to act on both of said linkage means to move all of said tong jaws simultaneously during the latter portion of such movement.

14. A gripping tong as specified in claim 13 wherein said initial portion of such movement of said other of said tong jaws is until all of said tong jaws are in substantially equal angular relationship.

15. A gripping tong as specified in claim 14 wherein during said latter portion of such movement said substantially equal angular relationship is maintained.

16. A gripping tong as specified in claim 13 additionally including biasing means operable to continually bias said at least two of said tong jaws towards said fully retracted position.

* * * * *